United States Patent [19]

Dorfman

[11] 4,342,105

[45] Jul. 27, 1982

[54] TIMEPIECE MODULE FRAME AND ASSEMBLY

[75] Inventor: Leonard Dorfman, Santa Clara, Calif.

[73] Assignee: Timex Corporation, Waterbury, Conn.

[21] Appl. No.: 161,807

[22] Filed: Jun. 23, 1980

[51] Int. Cl.[3] ..... G04C 23/02

[52] U.S. Cl. ..... 368/88; 368/82

[58] Field of Search ..... 339/17 R, 17 L; 29/827, 29/852; 350/331 R, 334; 368/83, 84, 88, 204, 239, 241, 242, 276, 280, 281, 294, 300; 220/319, 320

[56] References Cited

U.S. PATENT DOCUMENTS

| | | | |
|---|---|---|---|
| 4,053,688 | 10/1977 | Perkins et al. | 368/88 |
| 4,165,607 | 8/1980 | Fedorowicz et al. | 350/334 X |
| 4,196,577 | 4/1980 | Ohno et al. | 368/294 X |
| 4,238,848 | 12/1980 | Yamaguchi et al. | 368/276 |

FOREIGN PATENT DOCUMENTS

| | | | |
|---|---|---|---|
| 5248367 | 4/1977 | Japan | 368/88 |
| 5248371 | 4/1977 | Japan | 368/84 |

*Primary Examiner*—Bernard Roskoski

*Attorney, Agent, or Firm*—William C. Crutcher; Edward J. Timmer; Joseph A. Biela

[57] ABSTRACT

A snap-together electronic watch module frame and assembly includes a plastic front pod member having a first recess to receive and locate the electrooptical display, a rear pod member having a second recess to receive the timepiece battery, and an intermediate pod member sandwiched therebetween adapted to carry and position a printed circuit board with an integrated circuit chip, oscillator, capacitor, conductors and the like thereon in preselected relation to the display and battery. The module assembly is held together by resilient gripping arms molded into either the front or rear pod member snap-fitted onto shoulders molded on the other pod member. The intermediate pod member is molded to include on or more depending alignment legs adapted to fit in alignment holes molded in the rear pod member to properly position the circuit board components relative to the display and battery. The intermediate pod member also includes a central opening to receive the integrated circuit chip and form a dam therearound into which encapsulant can be poured to protect the chip, elongated guide slots in opposite edges into which flexible connectors are positioned to electrically connect the display and printed circuit board contact terminals and, if desired, a backlight locator.

9 Claims, 10 Drawing Figures

TIMEPIECE MODULE FRAME AND ASSEMBLY

FIELD OF THE INVENTION

The present invention relates to electronic timepieces equipped with an electrooptical display such as a liquid crystal display and, more particularly, to an improved watch frame and module assembly incorporating the display, electronic components such as integrated circuit chip, oscillator, etc. and battery into a neat package.

DESCRIPTION OF THE PRIOR ART

Myriad module assembly constructions for liquid crystal display and similar electrooptical timepieces have been developed over the past several years in an attempt to reduce the number of components, facilitate manufacture and assembly and improve the reliability of the timepiece.

For example, the Lazzery U.S. Pat. No. 4,012,117 issued Mar. 15, 1977 discloses a module assembly for a liquid crystal display watch which includes numerous components including an apertured, generally rectangular plastic frame having downwardly extending legs at each corner and carrying elongated resilient conductive connectors on opposite longitudinal sides. A conventional liquid crystal display is held against the top surface of the frame by clamp means with the electrical terminals of the display in contact with the resilient connectors on the frame while a generally rectangular carrier member having holes at each corner is mounted in compression against the rear surface of the frame by inserting the legs through the holes in the carrier member and hot staking the ends of the legs against of the carrier member. The carrier member has a semiconductor chip mounted centrally thereon and metallized circuit paths extending from the chip and terminating along longitudinal sides of the carrier member in a plurality of contact terminals which are in contact with the resilient conductive connectors of the frame when the frame and carrier member are held together in compression. Various inputs to the semiconductor chip are provided by connector pins depending from the carrier member for insertion into a printed circuit board therebelow.

A somewhat similar module assembly is shown in the Yasuda et al. U.S. Pat. No. 4,064,689 issued Dec. 27, 1977. However, Yasuda et al. interpose a first flexible printed sheet carrying a wiring pattern between the electrooptical display and the front side of a substrate to connect the display and a semiconductor chip on the substrate together. A second flexible printed circuit sheet is disposed at the rear side of the substrate carrying the battery, oscillator circuit as well as other electrical components to connect them to certain conductors associated with the chip.

The Murakami et al. U.S. Pat. No. 4,075,825 issued Feb. 28, 1978 discloses an electronic timepiece comprising an upper watch case and bottom caseback to form a so-called watch body. Sandwiched between the case and caseback inside the watch body is a plastic lead package frame on the upper side of which is mounted an integrated circuit chip and on the bottom side of which is mounted a printed circuit board carrying a quartz crystal oscillator, trimmer capacitor, battery, etc. The lead package frame includes an elongated slot on opposite sides of the chip to receive conductive connectors to connect the display leads to the output leads from the chip. The integrated circuit chip is mounted in a cavity in the front side of the lead package frame and epoxy resin is poured into the cavity to cover and protect the chip.

The Ikuta U.S. Pat. No. 4,086,696 issued May 2, 1978 relates to a method for packaging circuit elements for an electronic analog watch such that the conventional printed circuit board is eliminated. In this patent, a onepiece lead frame is formed of copper sheet and an integrated circuit chip is die bonded directly onto the lead frame. A molded thermoplastic base plate is provided for supporting the lead frame and includes upwardly projecting studs which are adapted to pass through holes in the lead frame and to thereafter be hot staked against the lead frame to secure it on the base plate. The base plate also functions to support the gear train of the timepiece and to hold the battery. In an alternative embodiment, the assembly also includes a thermoplastic cover plate adapted to cover the entire lead frame. The cover plate is molded to include a housing surrounding the chip into which epoxy resin or other potting compound is placed.

The module assembly described in the Uchida U.S. Pat. No. 4,095,334 issued June 20, 1978 eliminates the need for a separate metallic lead frame. For example, the patented module assembly includes an insulating substrate or circuit board having a circuit pattern on one or both sides with an integrated circuit chip and quartz oscillator mounted on the sides and connected to the circuit pattern. This substrate is sandwiched between molded plastic front and rear frame members which are held together by hot staked legs or studs from the front frame member extending through the substrate and rear frame member. The front frame member is molded to receive an electrooptical display whereas the rear frame member is molded to receive a battery. The display leads are connected to a circuitry pattern on the substrate by conductive rubber connectors to eliminate soldering.

The Iinuma U.S. Pat. No. 4,144,705 issued Mar. 20, 1979 illustrates a module assembly in which the semiconductor chip is bonded to the lead frame and the lead frame/chip subassembly is positioned between upper and lower support frames. The lower support frame includes a chip-receiving cavity which is surrounded by a peripheral chamber formed into mating surfaces of the support frames and in which bonding material holding the support frames together collects and functions as a peripheral seal around the chip. A liquid crystal display is received in a suitable recess in the front surface of the upper frame while the power cell and electrical components are received in various recesses in the bottom surface of the lower frame.

The Fedorowitz et al. U.S. Pat. No. 4,165,607 issued Aug. 28, 1979 discloses a module assembly in which a ceramic substrate carrying an integrated circuit chip, oscillator, incandescent bulb and other electronic components is adhered to the bottom of a molded plastic chassis member by an epoxy preform and in which a liquid crystal display and polarizer sheet are positioned against the top of the chassis member by a clip that snap-fits onto projections on the chassis member. The display is connected electrically to the components on the ceramic substrate by flexible conductors. In addition, raised wall portions of the chassis member function to properly align the display and polarizer sheet.

Various other module assemblies for use in electronic timepieces are shown in the Yamazaki U.S. Pat. No. 3,910,029 issued Oct. 7, 1975; the Haber U.S. Pat. No. 3,975,899 issued Aug. 24, 1976; the Dekel U.S. Pat. No. 3,992,870 issued Nov. 13, 1976 and the Murakami U.S. Pat. No. 4,120,147 issued Oct. 17, 1978.

SUMMARY OF THE INVENTION

The present invention provides an improved module frame and module assembly for efficiently packaging together the various components of an electronic timepiece in which time is indicated by means of an electro-optical display.

The module assembly is especially advantageous in that the various components can be simply sandwiched together in predetermined sequence between module frame members and maintained in the assembled state by simply snap-fitting certain frame members together.

The module assembly is also advantageous in that it provides a neat components package which can be easily inserted into a watch case during manufacture and assembly or, conversely, can be easily removed in the event repair or replacement is necessary.

The module assembly is additionally advantageous in that the module construction provides for a large size display area in a limited amount of space, this being especially beneficial for a ladies' watch.

Briefly, the improved module frame and assembly includes three molded plastic frame members which support, align and at least partially enclose the electro-optical and electronic components in a neat package. The module frame members comprise a first (front) pod member having a recess molded therein to receive and positively locate the electrooptical display and an aperture configured to provide a window for viewing the display, a second (rear) pod member having one or more recesses molded therein to receive the timepiece battery and an intermediate member disposed between the first and second pod members and molded to serve several important functions. An important feature of the invention is that one or both of the first and second pod members includes resilient gripping means such as molded resilient gripping arms extending toward the other pod member and being adapted for releasable snap-fit type engagement onto shoulders or other suitable features molded into the other pod member. Another important feature of the invention is that the intermediate pod member is attached to a printed circuit board carrying electronic timepiece components such as an integrated circuit chip, quartz crystal oscillator, one or more capacitors and conductors and preferably is molded to provide alignment means such as depending alignment legs to cooperate with alignment means such as alignment holes in the rear pod member to locate the printed circuit board and electronic components thereon in preselected position relative to the display and battery. The intermediate pod member preferably is molded with an inner wall defining a chip-receiving aperture to accommodate the integrated circuit chip on the substrate and provide a dam or enclosure into which encapsulant can be placed to protect the integrated circuit chip and also with an outer wall defining elongated guide slots in opposite edges to receive conductive elastomeric connectors for electrically connecting the display to the electronic components on the printed circuit board. If the electrooptical display is backlighted, the intermediate pod member includes a molded locator for properly positioning the backlight relative to the display and, in particular, to a light pipe positioned behind the display.

BRIEF DESCRIPTION OF THE DRAWINGS

For a more complete understanding of the invention, reference is made hereafter to the drawings in which.

DESCRIPTION OF THE PREFERRED EMBODIMENTS

Figure 1:
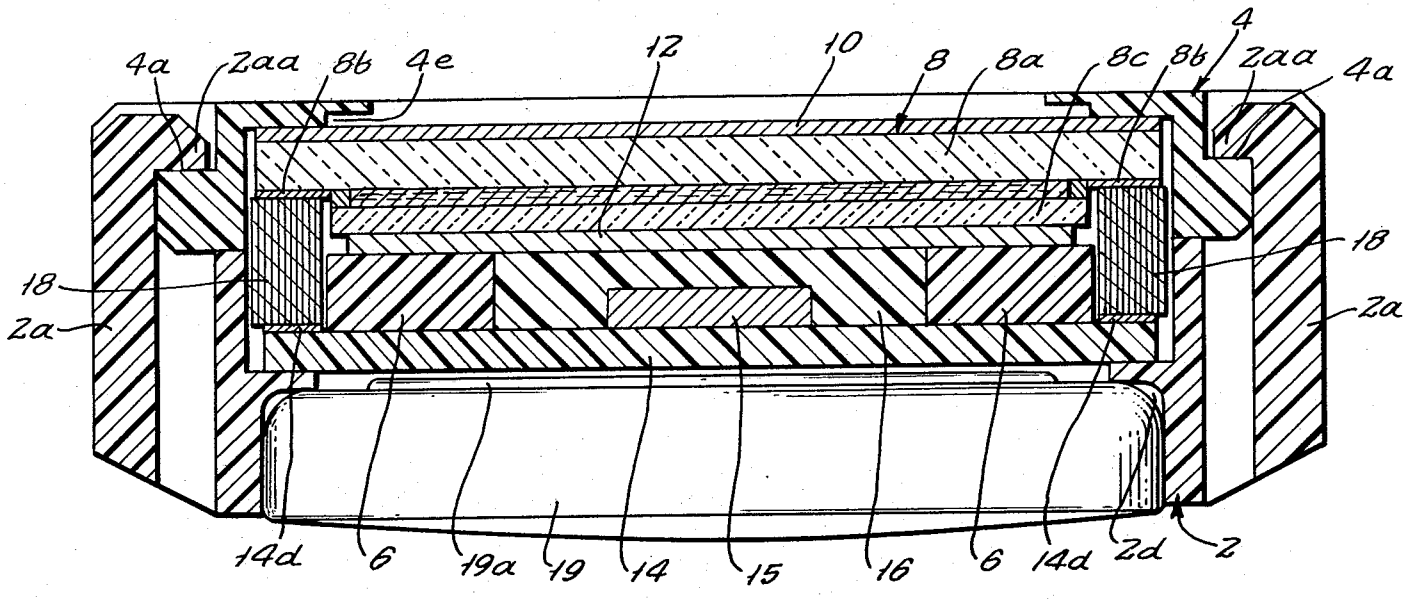
FIG. 1 is a sectional view through the module assembly.

FIG. 1 shows the three molded plastic (e.g. glass filled nylon) module frame members along with other components snapped together in operative relation. For example, rear pod member 2 is shown engaged to front pod member 4 by upwardly extending, resilient gripping arms 2*a* molded on opposite exterior sidewalls of the rear pod member and snap-fitted to generally horizontal shoulders 4*a* molded onto opposite side walls of the front pod member. Disposed between the front and rear pod members is a generally flat, intermediate pod member 6 described more fully hereinbelow. Exemplary electrooptical and electronic timepiece components also shown in FIG. 1 are liquid crystal display 8 with associated front and rear polarizers 10 and 12, printed circuit board 14 having integrated circuit chip 15 thereon surrounded by encapsulant 16, and flexible electrical connectors 18 positioned between the contact terminals of the display and those of the printed circuit board as described in more detail hereinbelow. Battery 19 is disposed in the bottom surface of the rear pod member.

Figure 2:
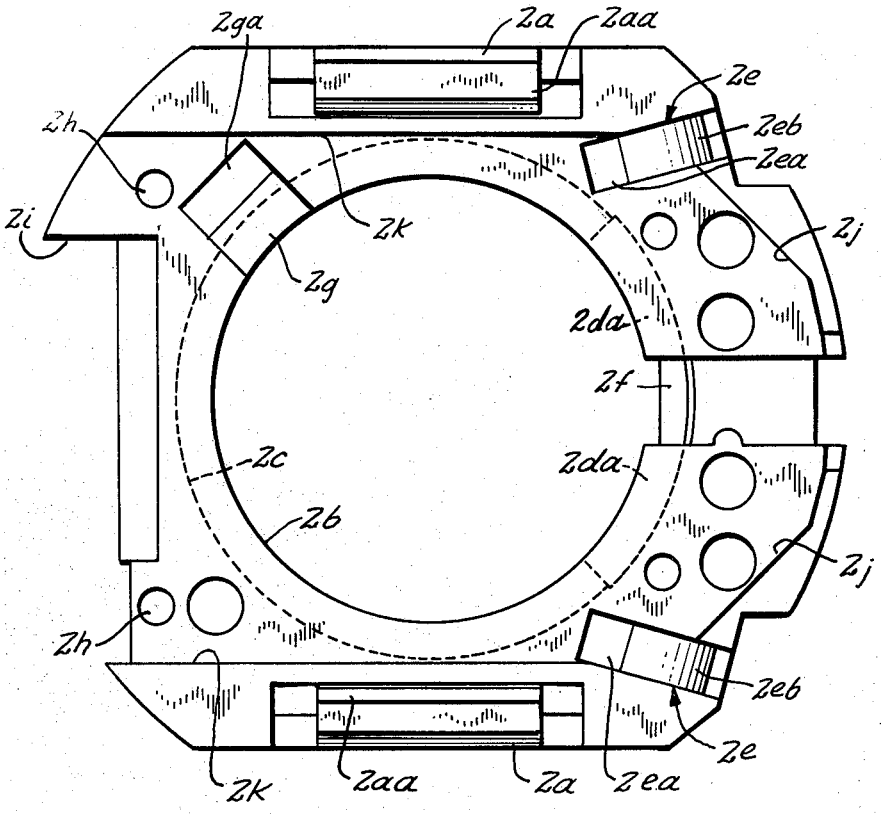
FIG. 2 is a plan view of the rear pod member.
Figure 3:
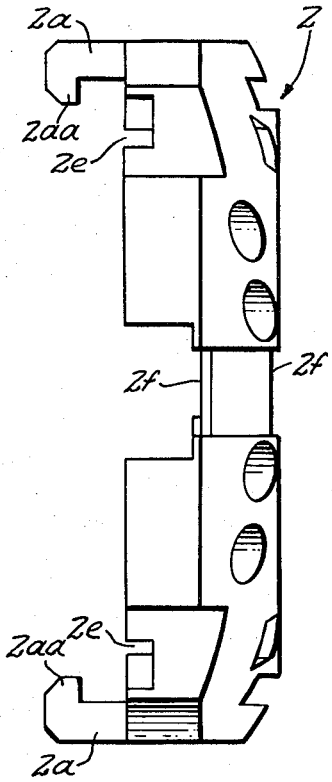
FIG. 3 is a side elevation of the pod member FIG. 2.
Figure 4:
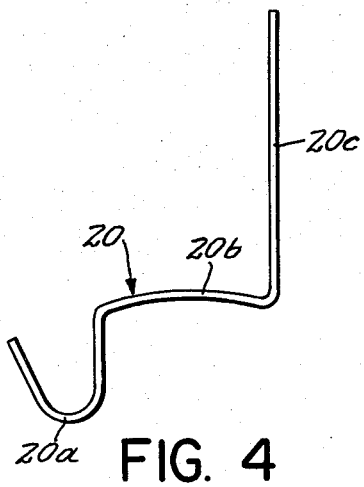
FIG. 4 is a side elevation of a switch contact member.
Figure 5A:
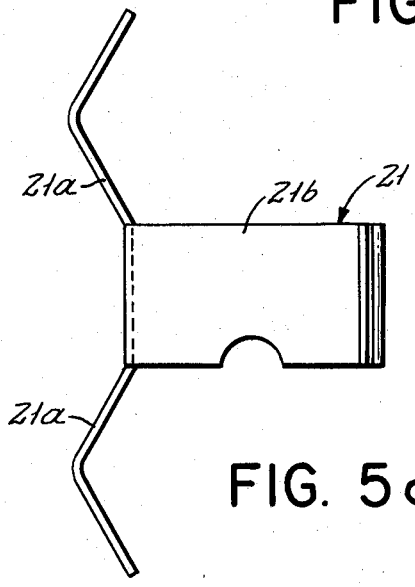
FIG. 5*a* is a plan view of the positive battery contact member and FIG. 5*b* is a side elevation of the negative battery contact member.
Figure 5B:
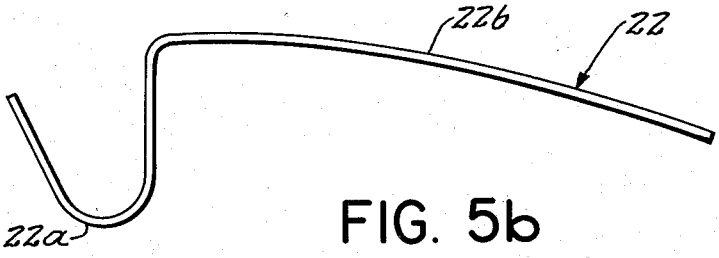

FIGS. 2 and 3 illustrate the rear pod member in more detail and show that it is bowl-shaped with a first central circular opening 2*b* and a second larger central circular opening 2*c* (dotted lines) intersecting together to form a battery-receiving recess 2*d* (FIG. 1) in the rear surface thereof. Slots 2*e* are provided in the front surface to receive and locate L-shaped switch contact members shown in FIG. 4. The sharply bent, depending portion 20*a* of the switch contact member is received in slot portion 2*ea* and the slightly arcuate portion 20*b* is received in shallow slot portion 2*eb* with the vertical post 20*c* of each switch contact extending upwardly on the outside of the module assembly so that pushbuttons on the watch case (not shown) can be brought to bear thereagainst for switching functions of the timepiece. Those skilled in the art will appreciate that the rear surface of the printed circuit board 14 includes terminal pads to contact against portions 20*b* of each switch contact when the board is sandwiched against the rear pod member as shown in FIG. 1. Slots 2*f* and 2*g* are also provided for the purpose of receiving battery contact members 21 and 22 shown in FIGS. 5*a* and 5*b* respectively. Battery contact member 21 shown in FIG. 5*a* includes two V-shaped portions 21*a* which extend into arcuate chambers 2*da* of the battery-receiving recess 2*d* to contact the positive terminal of the power cell and a generally U-shaped portion having spaced legs 21*b* disposed in shallow slots 2*f*. Battery contact member 22 shown in FIG. 5*b* includes a sharply bent depending portion 22*a* adapted for receipt in slot portion 2*ga* while the long slightly arcuate portion 22*b* extends into the battery-receiving recess 2*d* to contact to negative battery terminal 19*a*, FIG. 1. The battery contact members 21 and 22 make contact with corresponding contact pads on the rear surface of the printed circuit board 14 when the module sandwich is assembled to supply power to the electronic components and display.

Rear pod member 2 also includes a pair of spaced alignment apertures 2*h* which function to locate the intermediate pod member 6 as described herebelow. Adjacent apertures 2*h* is molded an elongated cut-out 2*i* for receiving a portion of the quartz crystal oscillator mounted on the printed circuit board. And the rear pod member has molded on opposite exterior sidewalls resilient gripping arms 2*a* which extend upwardly toward the front pod member and terminate in a hook-like portion 2*aa* for snap-fitting onto shoulders 4*a* of the front pod member.

Figure 6:
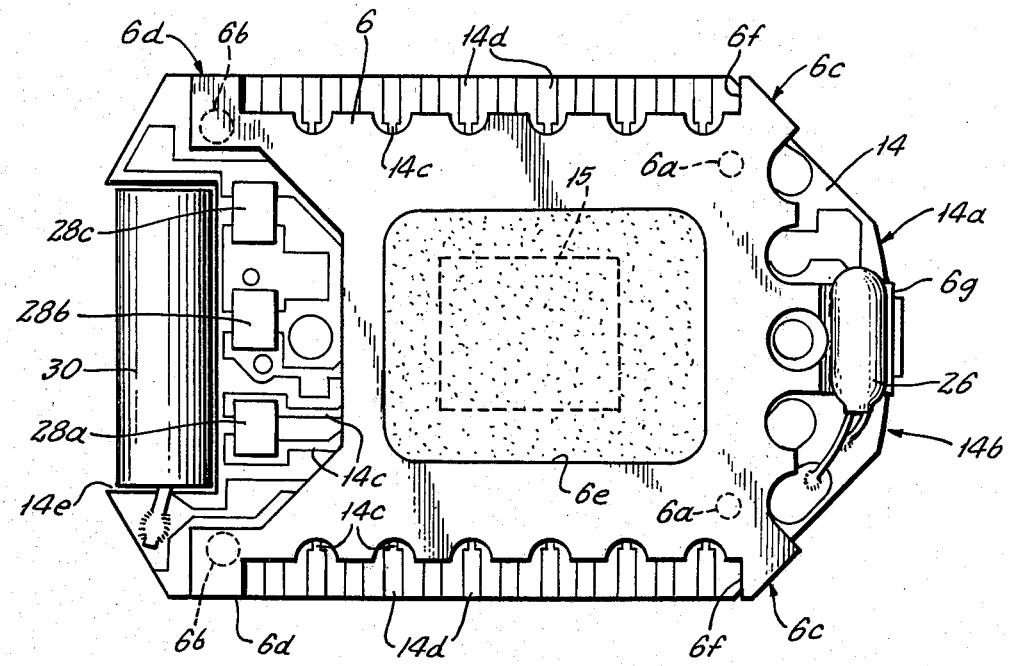
FIG. 6 is a plan view of the intermediate pod member and attached printed circuit board.
Figure 7:
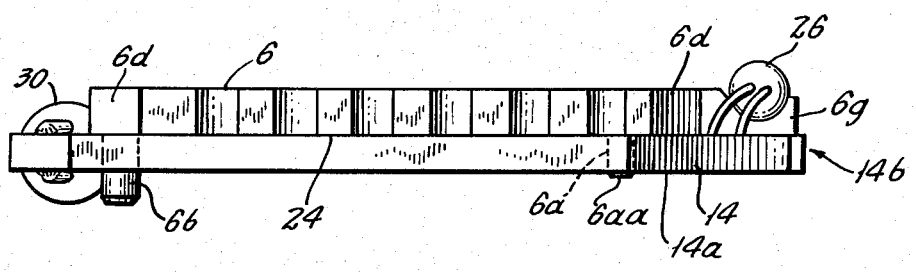
FIG. 7 is a side elevation of the pod member and board of FIG. 6.

The intermediate pod member 6 and printed circuit board 14 are shown attached together in FIGS. 6 and 7. The pod member is molded to include a pair of attachment legs 6*a* near one end and another pair of longer alignment legs 6*b* near the other end while the printed circuit board includes corresponding alignment holes through which the legs 6*a* and 6*b* extend. As shown most clearly in FIG. 7, legs 6*a* extend slightly beyond the free surface 14*a* of the printed circuit board and terminate in retaining heads 6*aa* formed by heat staking the end of each leg against the free circuit board surface 14*a*. Longer legs 6*b*, on the other hand, extend significantly past the free surface 14*a* and are adapted to be received and located in the spaced alignment holes 2*h* in the rear pod member. At the same time, positioning surfaces 6*c* and 6*d* molded on the corners of intermediate pod member and the nose portion 14*b* of the printed circuit board are located adjacent the upstanding walls 2*j* and 2*k* of the rear pod member as is apparent by comparing FIGS. 6 and 2.

The printed circuit board has an integrated circuit chip 15 attached centrally thereon, for example, by adhesive, and connected to a lead pattern comprising conductive paths 14*c* plated or otherwise formed on the circuit board. The intermediate pod member includes a central aperture 6*e* of rectangular outline to surround the chip 15 and provide a dam or enclosure into which encapsulant 16, such as epoxy resin, is poured and cured to protect and seal the chip.

Figure 9:
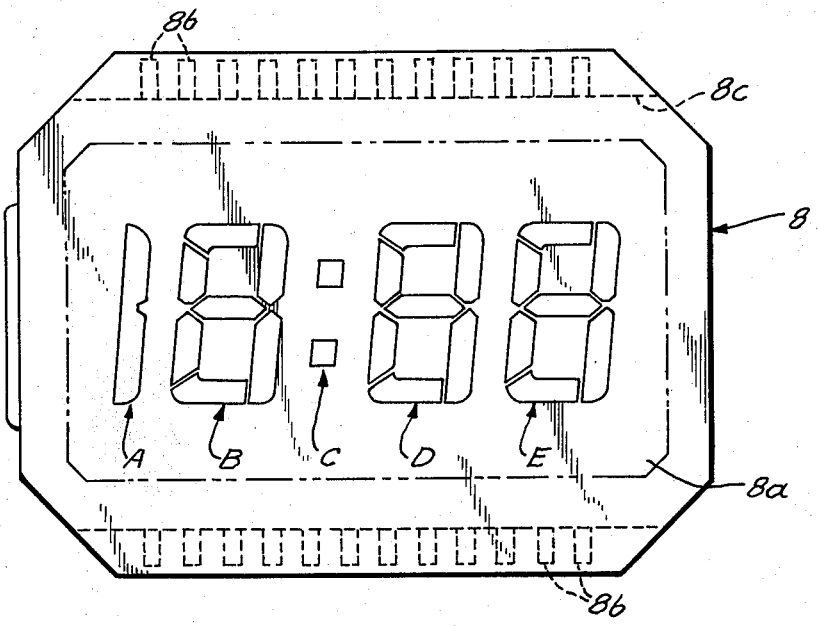
FIG. 9 is a plan view of the liquid crystal display.

As shown most clearly in FIG. 6, the circuit pattern 14*c* on the printed circuit board terminates at opposite longitudinal sides in a plurality of spaced contact terminals 14*d* which are connected electrically by flexible connectors 18 to similarly configured contact terminals 8*b* on opposite longitudinal sides of the liquid crystal display 8 positioned thereabove, FIGS. 1 and 9. To this end, the intermediate pod member 6 includes molded guide slots 6*f* which together with upright walls 2*k* of the rear pod member define an elongated chamber to receive and positively locate the rectangular connectors 18 therein to insure proper electrical contact is made between the facing rows of contact terminals of the display and printed circuit board.

The printed circuit board also may optionally include an incandescent bulb 26 or other backlight for the display and the intermediate pod member as a result can be molded to include a backlight support 6*g* having a recess to receive and cradle the backlight in proper position relative to the display. Of course, a well known planar light pipe is usually positioned behind rear polarizer 12 of the display to direct light from bulb 26 upwardly through the display.

Other components mounted on the printed circuit board include fixed ceramic capacitors 28*a*, 28*b* and 28*c*, one of which, e.g. 28*b*, may be selected to tune the oscillator circuit which includes the encapsulated quartz crystal 30 mounted in end slot 14*e* of the printed circuit board. It is apparent from FIG. 6 that the intermediate pod member 6, in addition to the other functions already set forth, also covers much of the fragile conductive paths 14*c* on the circuit board to protect them.

Figure 8:
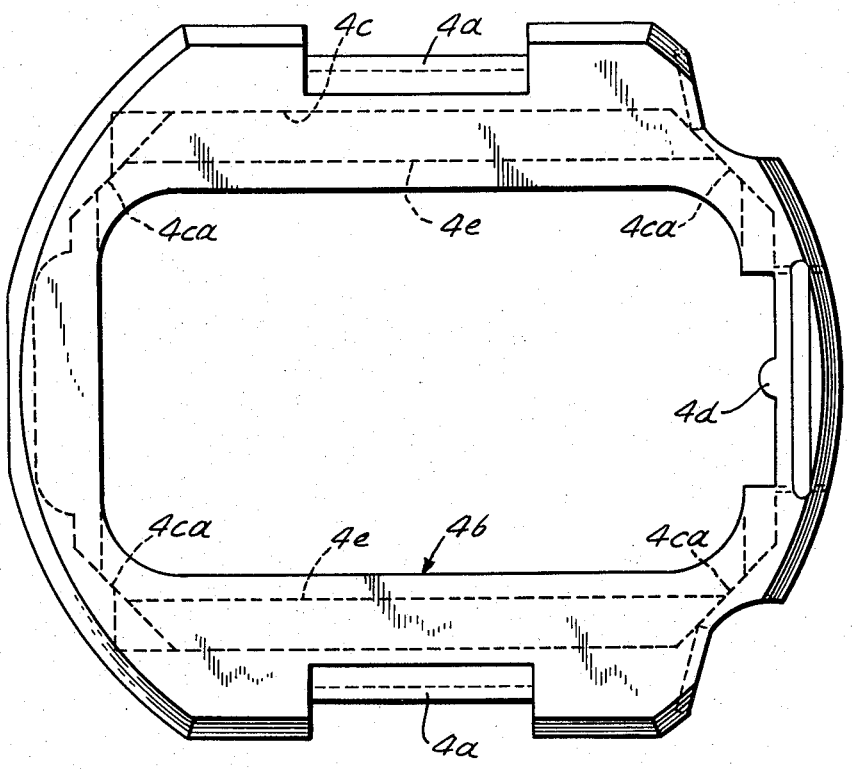
FIG. 8 is a plan view of the front pod member.

The front pod member 4 is shown in greater detail in FIG. 8. It is generally tray-shaped and includes a central window 4*b* through which the liquid crystal display 8 is viewed. A shaped recess 4*c* is molded into the bottom side of the front pod member to receive the display shown in FIG. 9. To this end, the recess 4*c* includes corners 4*ca* chamfered 45° to locate the chamfered corners of the display. Also, cylindrical locator 4*d* is molded into the recess 4*c* for the same purpose. In one embodiment of the invention, the front polarizer sheet 10 is cut with a plan outline like that of the display and the display with the free polarizer sheet thereon are placed in the recess 4*c* and located therein by the chamfered corners. In another embodiment, the polarizer sheet can be cut smaller in size, although still with chamfered corners, to be received in a smaller recess 4*e* molded closer to the top surface of the front pod member. This embodiment permits the display to be brought closer to the viewer.

And, as already mentioned, the front pod member has elongated horizontal shoulders 4*a* molded on opposite longitudinal exterior sidewalls to effect snap-fit engagement with gripping arms 2*a* of the rear pod member, FIG. 1.

The liquid crystal display 8 mounted in recess 4*c* of the front pod member includes a front glass plate 8*a* having the transparent display electrode pattern thereon forming display characters A–E which terminates along opposite longitudinal sides of plate 8*a* in first and second rows of spaced contact terminals 8*b*. A smaller rear glass plate 8*c* is spaced behind the front plate and sealed peripherally thereto with a conventional nematic liquid crystal material in the space between the two glass plates, FIG. 1. When the module members are assembled together, the rows of contact terminals 8*b* on the front glass plate of the display are aligned facing and in registry with the rows of contact terminals 14*d* on the printed circuit board by alignment legs 6*b* in alignment holes 2*h* and the flexible conductive connectors 18 are disposed between the facing rows of contact terminals to make electrical connection. Of course, the display characters A–E are visible, when actuated, through the window 4*b* of the front pod member. Those skilled in the art will appreciate that other types of well known electrooptical displays such as electrochromic are equally usable in the invention.

Those skilled in the art will also recognize that the completed module assembly of FIG. 1 is mounted in a conventional watch case (not shown) having pushbuttons by which the wearer can change the functions of the display, for example, from hours-minutes to month-date or to seconds, and that the pushbuttons will contact against vertical posts 20c of the switch contact members 20 for this purpose. Of course, the watch case may be formed of metal, plastic or other materials and may, if desired, include a releasable caseback as is well known in the art to gain access to the battery 19 or the module assembly itself.

Although the particular electrical circuitry and electronic components discussed hereinabove are preferred, it will be apparent that other types and arrangements of components and circuit paths as well as other changes and modifications to the module members can be made or employed and it is desired to cover in the appended claims all such modifications and changes as fall within the true spirit and scope of the invention.

I claim:

1. A snap-together module frame for packaging an electrooptic display, printed circuit board carrying electronic components and a battery for an electronic timepiece comprising:

(a) a first plastic pod member having a first recess to receive the electrooptical display and an aperture configured to provide a window for viewing the display, (b) a second plastic pod member having a second recess shaped to receive the battery and having first alignment means, (c) an intermediate plastic pod member adapted to carry the printed circuit board, said intermediate pod member being disposed between said first and second pod members and having second alignment means to cooperatively engage the first alignment means of said second pod member to locate the printed circuit board and electronic components thereon in preselected relation to said display and battery, and wherein the intermediate pod member further includes an outer wall defining edge slots to receive conductive connectors for electrically coupling the electronic components on said printed circuit board to said display, second pod member further having a pair of resilient gripping arms extending toward said first pod member along opposite sides and said first pod member having a pair of gripped surfaces on opposite sides against which the resilient arms are snap-fitted.

2. The module frame of claim 1 wherein the first alignment means of said second pod member comprises at least one aperture therein and wherein the second alignment means of said intermediate pod member comprises at least one leg extending toward said second pod member and adapted to be received and located in said aperture.

3. The module frame of claim 1 wherein the intermediate pod member is molded to include an inner wall defining an open dam surrounding an electronic component on the printed circuit board, said dam receiving encapsulant to cover and protect said electronic component.

4. The module frame of claim 1 wherein the intermediate pod member further includes a locating portion for properly positioning a backlight relative to said display.

5. A snap-together module assembly for a battery-powered electronic timepiece comprising:

(a) an electrooptical display for providing a display of time information, (b) a printed circuit board carrying electronic components including an integrated circuit chip and a pattern of conductors for providing a time signal to said display, (c) a plastic front pod member molded to include a first recess to receive the electrooptical display and an aperture configured to provide a window for viewing the display, (d) a plastic intermediate pod member disposed behind the front pod member and having a front side facing the front pod member, a rear side and a chip-receiving aperture extending therethrough from one side to the other, and an outer wall defining elongated slots in opposite edges of said intermediate pod, the rear side of the intermediate pod member being attached to the printed circuit board such that the integrated circuit chip is received in said chip-receiving aperture, said rear side being molded to include at least one alignment leg extending rearwardly therefrom, (e) encapsulant placed in the chip-receiving aperture of said intermediate pod member around and covering said integrated circuit chip to protect it, (f) a plastic rear pod member positioned behind the intermediate pod member, said rear pod member being molded to include a battery-receiving recess in the side facing away from said intermediate pod member and at least one alignment aperture in the side facing said intermediate pod member to receive the alignment leg and thereby locate the printed circuit board and electronic components thereon in preselected relation to said display, and (g) means for electrically connecting said electronic components to said display, including a pair of resilient conductive elastomeric connectors positioned therebetween, said intermediate pod member including an outer wall defining a pair of elongated slots into which the conductive connectors are received, one of said front and rear pod members further being molded to include a pair of resilient gripping arms extending toward the other of said pod member and said other pod member being molded to include a pair of gripped surfaces against which the resilient arms are snap-fitted to releasably hold the module components (a) through (g) together in a neat package.

6. The module assembly of claim 5 wherein the intermediate pod member further includes a locating portion for properly positioning a backlight for illuminating said display and wherein a planar light pipe is positioned behind the display in light-conducting relation to the backlight.

7. The module assembly of claim 5 wherein the printed circuit board also carries a quartz crystal oscillator and multiple fixed capacitors to form an oscillator circuit with said chip, one of which capacitors functions to tune the oscillator circuit.

8. A snap-together module assembly for a battery-powered electronic timepiece, comprising:

(a) an electrooptical display for providing a display of time information, said display having first and second separate rows of electrical contact terminals spaced from and parallel to one another, (b) a printed circuit board carrying electronic components for providing a time signal to the display including an integrated circuit chip, quartz crystal oscillator, capacitor and a pattern of conductors terminating in third and fourth separate rows of electrical contacts spaced from and parallel to one another in the same configuration as said first and second rows of contact terminals of said display, said printed circuit board including multiple first alignment apertures therethrough, (c) a plastic front pod member molded to include a first recess to receive the electrooptical display with the first and second rows of said contact terminals facing rearwardly and an aperture configured to provide a window for viewing the display, said front pod member having exterior sidewalls, (d) a plastic intermediate pod member disposed behind the display with a front side facing the display and a rear side, said intermediate pod member having an inner wall defining a chip-receiving aperture extending therethrough from one side to the other and an outer wall defining first and second elongated guide slots aligned behind each of said first and second rows of contact terminals, the rear side of the intermediate pod member being attached to the printed circuit board with the integrated circuit chip received in the chip-receiving aperture and the third and fourth rows of said contact terminals facing toward the first and second contact terminals of said display through said guide slots, said rear side being molded to include multiple alignment legs extending rearwardly therefrom through and beyond the first alignment apertures of said printed circuit board, (e) encapsulant placed in the chip-receiving aperture of said intermediate pod member around and covering said integrated circuit chip to protect it, (f) a plastic rear pod member positioned behind the intermediate pod member and printed circuit board, said rear pod member being molded to include a battery-receiving recess in the rearward facing side and multiple second alignment apertures in the side facing the intermediate pod member to receive the depending alignment legs of said intermediate pod member and thereby locate the third and fourth rows of the contact terminals of said printed circuit board in spaced registry with the first and second rows of contact terminals on the display, said rear pod member having exterior sidewalls, and (g) an elongated elastomeric conductive connector positioned in each of said guide slots between the facing rows of contact terminals to connect said terminals electrically together, said rear pod member further being molded to include a resilient gripping arm extending toward said front pod member from opposite exterior sidewalls and said front pod member being molded to include gripped surfaces on opposite exterior sidewalls against which the resilient gripping arms are snap-fitted to releasably hold the module components (a) through (g) together in a neat package with the display connected to said electronic components.

9. The module assembly of claim 8 wherein the gripping arms each terminate in an inverted L-shaped latch which is snap-fitted on the gripped shoulder of the front pod member.

* * * * *